US009700913B2

(12) United States Patent
Hung

(10) Patent No.: US 9,700,913 B2
(45) Date of Patent: Jul. 11, 2017

(54) CAULKING GUN HAVING CHANGEABLE CARTRIDGE

(71) Applicant: SIANG SYUAN FU ENTERPRISE CO., LTD., Changhua County (TW)

(72) Inventor: Hung Chih Hung, Changhua (TW)

(73) Assignee: SIANG SYUAN FU ENTERPRISE CO., LTD., Changhua County (TW)

( * ) Notice: Subject to any disclaimer, the term of this patent is extended or adjusted under 35 U.S.C. 154(b) by 0 days.

(21) Appl. No.: 15/079,921

(22) Filed: Mar. 24, 2016

(65) Prior Publication Data

US 2016/0199872 A1 Jul. 14, 2016

Related U.S. Application Data

(63) Continuation-in-part of application No. 13/965,247, filed on Aug. 13, 2013, now abandoned.

(51) Int. Cl.
*B05C 17/01* (2006.01)
*B05C 17/005* (2006.01)

(52) U.S. Cl.
CPC .... *B05C 17/0116* (2013.01); *B05C 17/00553* (2013.01); *B05C 17/00596* (2013.01); *B05C 17/01* (2013.01)

(58) Field of Classification Search
CPC ..... B05C 17/0116; B05C 17/00553; B05C 17/00596; B05C 17/01
USPC ..... 222/326, 327
See application file for complete search history.

(56) References Cited

U.S. PATENT DOCUMENTS

| | | | |
|---|---|---|---|
| 5,058,769 | A | 10/1991 | Kurtz |
| 5,064,098 | A | 11/1991 | Hutter, III et al. |
| 5,104,005 | A | 4/1992 | Schneider, Jr. et al. |
| 5,156,305 | A | 10/1992 | Eyre |
| RE34,487 | E | 12/1993 | Keller |
| 5,336,014 | A | 8/1994 | Keller |
| 5,381,931 | A | 1/1995 | Chang |
| 5,535,922 | A | 7/1996 | Maziarz |
| 5,755,362 | A | 5/1998 | Rodriguez et al. |
| 5,875,928 | A | 3/1999 | Muller |
| 5,887,765 | A | 3/1999 | Broesamle |
| 5,893,488 | A | 4/1999 | Hoag |
| 5,924,600 | A | 7/1999 | Keller |
| 6,123,235 | A | 9/2000 | Hsu |
| 6,585,696 | B2 | 7/2003 | Petersen |
| 6,691,899 | B2 | 2/2004 | Sung |
| 6,938,799 | B1 | 9/2005 | Berntsen |
| 7,011,238 | B1 | 3/2006 | Sung |

(Continued)

*Primary Examiner* — Donnell Long
(74) *Attorney, Agent, or Firm* — Muncy, Geissler, Olds & Lowe, P.C.

(57) ABSTRACT

A caulking gun includes a housing having a channel opened upwardly, a supporting bracket engageable into the channel of the housing and having an opening for detachably attaching a cartridge member, and a latch device having a latch member slidably attached to the housing and movable relative to the housing for selectively engaging with the supporting bracket and for preventing the supporting bracket and the cartridge member from being disengaged from the housing. The latch member includes two anchors engageable into the channel of the housing for engaging with the supporting bracket and for preventing the supporting bracket and the cartridge member from being disengaged from the housing.

20 Claims, 9 Drawing Sheets

(56) References Cited

U.S. PATENT DOCUMENTS

| | | | | |
|---|---|---|---|---|
| 7,637,398 | B2 | 12/2009 | Sung | |
| 8,192,198 | B2 * | 6/2012 | An | A61C 9/0026 222/135 |
| 8,783,514 | B2 | 7/2014 | Terhardt | |
| 8,820,581 | B2 | 9/2014 | Baldelli | |
| 2002/0130141 | A1 | 9/2002 | Gardos | |

* cited by examiner

CAULKING GUN HAVING CHANGEABLE CARTRIDGE

BACKGROUND OF THE INVENTION

Field of the Invention

The present invention is a CIP of application Ser. No. 13/965,247, filed Aug. 13, 2013, the entire contents of which are hereby incorporated by reference.

Description of the Prior Art

Various kinds of typical caulking guns or fluid dispensing guns have been developed and provided for receiving or engaging with the dispensing cartridges or packages and for depressing or squeezing or operating the dispensing cartridges or packages to release or dispense the fluid or liquid contained in the dispensing cartridges or packages.

For example, U.S. Pat. No. 5,058,769 to Kurtz, U.S. Pat. No. 5,156,305 to Eyre, U.S. Pat. No. 5,381,931 to Chang, U.S. Pat. No. 5,887,765 to Broesamle, U.S. Pat. No. 6,123,235 to Hsu, U.S. Pat. No. 6,691,899 to Sung, U.S. Pat. No. 7,011,238 to Sung, and U.S. Pat. No. 7,637,398 to Sung disclose several of the typical caulking guns or fluid dispensing guns each comprising a component supporting bracket for receiving or engaging with or for supporting a fluid or liquid dispensing cartridge or package and for dispensing the fluid or liquid contained in the dispensing cartridge or package.

However, the component supporting bracket may only be used for receiving or engaging with or for supporting a single fluid or liquid dispensing cartridge or package, but may not be used for receiving or engaging with or for supporting dual component dispensing cartridges or packages.

U.S. Pat. No. 5,064,098 to Hutter, III, et al., and U.S. Pat. No. 5,104,005 to Schneider, Jr. et al. disclose the other typical caulking guns or fluid dispensing guns each also comprising a component supporting bracket for receiving or engaging with or for supporting a dual dispensing cartridge or package and for dispensing the fluid or liquid contained in the dual dispensing cartridge or package.

However, the dual dispensing cartridge or package may not be easily and quickly replaced or changed with the new ones, in addition, the typical caulking guns or fluid dispensing guns may not be used for receiving or engaging with the other dispensing cartridges or packages of different sizes or shapes or volumes or standards.

US 20020130141 discloses that the cartridge retainer is provided composed of a lower frame part and an upper frame part riding on two side edge guide pins, respectively, and in such a manner that it opens up only sufficiently to allow the removal of the cartridge when the gate of the retainer is open. The flat cartridge holder is shown with the upper planar frame portion raised on the guide pins to its uppermost extremity, at which point the new cartridges with different-shaped flanges may be inserted into the holder. The upper frame portion is then lowered on guide pins such that the assembly may now be attached in the regular mounting grooves at the forward part of the dispenser gun. Since the lower frame part is fixedly connected to the housing, the upper planar frame portion must be raised again in every replacement of a new cartridge, so that it is not easily and not quickly replaced or changed with the new ones of different sizes or shapes or volumes or standards with the same caulking gun or fluid dispensing gun.

The present invention has arisen to mitigate and/or obviate the afore-described disadvantages of the conventional caulking guns or fluid dispensing guns.

SUMMARY OF THE INVENTION

The primary objective of the present invention is to provide a caulking gun or fluid dispensing gun including an improved structure or configuration for allowing the dispensing cartridge package to be easily and quickly replaced or changed with the new ones of different sizes or shapes or volumes or standards with the same caulking gun or fluid dispensing gun.

In accordance with one aspect of the invention, there is provided a caulking gun comprising: a housing including a gun handle extended therefrom for being grasped by a user, and including a trigger pivotally attached to said housing, and including a channel formed in a front portion of said housing and opened laterally to form an opening; a supporting bracket slidably insertable into said channel of said housing via said opening of said channel and including an opening, an entirety of said supporting bracket being slidable relative to said housing in a single movement of said supporting bracket, said opening of said supporting bracket is for changeably disposing a cartridge member therethrough, said cartridge member including an end panel, there being a space which is between said supporting bracket and said front portion of said housing, wider than a thickness of said end panel of cartridge member and for receiving said end panel.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
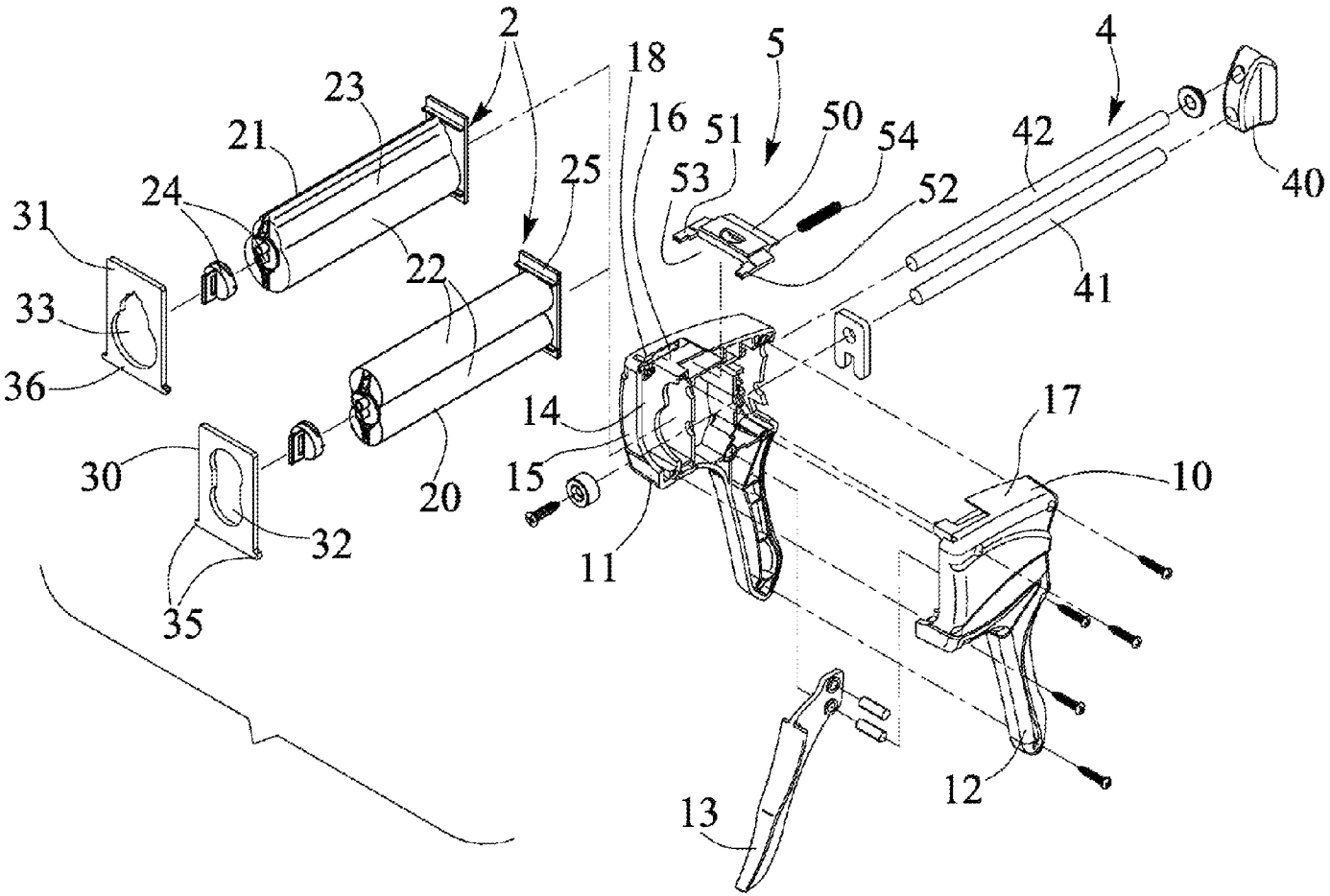
FIG. 1 is a partial exploded view of a caulking gun or fluid dispensing gun in accordance with the present invention.
Figure 2:
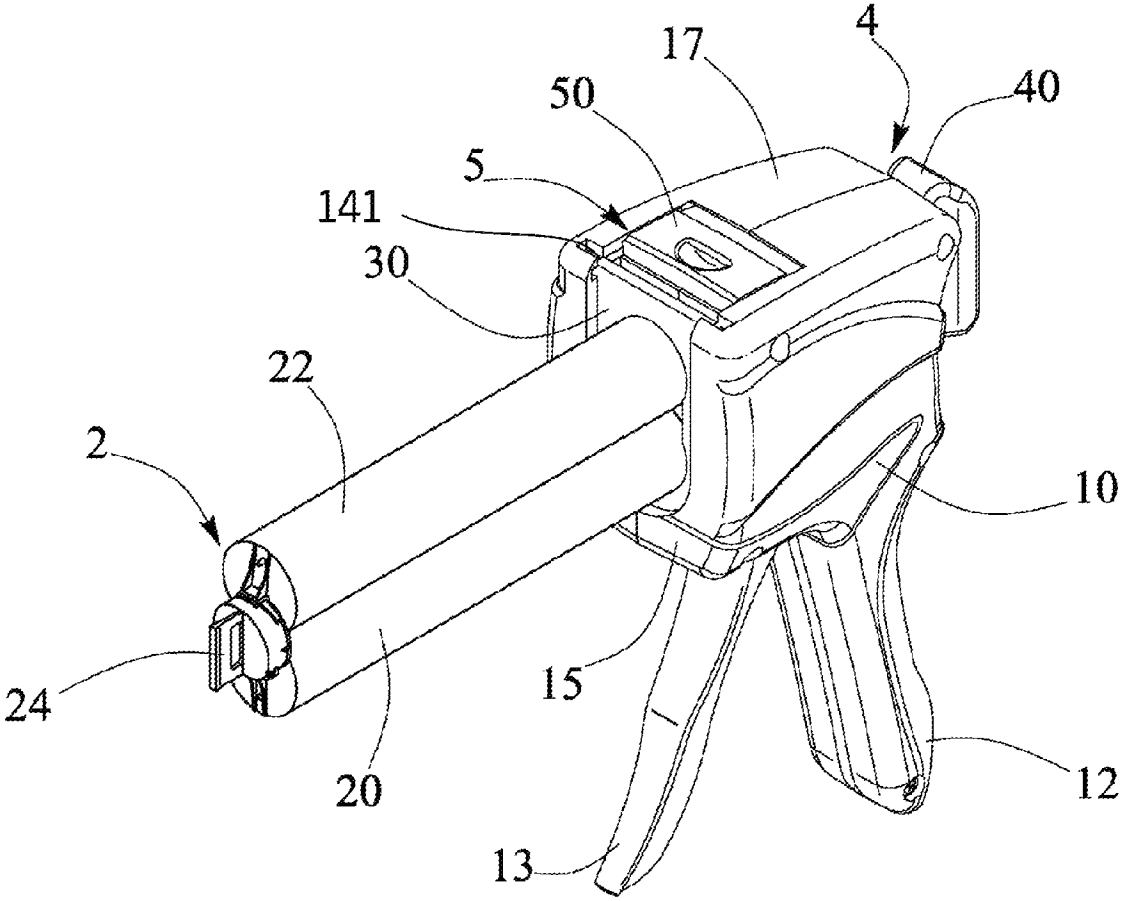
FIG. 2 is a perspective view of the caulking gun or fluid dispensing gun.

Referring to the drawings, and initially to FIGS. 1-4, a caulking gun or fluid dispensing gun in accordance with the present invention comprises a gun body or receptacle or housing 10 including one or more (such as two) housing members 11 to be mounted or secured or coupled together with latches or fasteners or the like (not illustrated), and including a gun handle 12 extended downwardly therefrom for being gripped or grasped or held by the user, and including a trigger 13 pivotally or rotatably attached or mounted or secured to the housing 10 for actuating or operating the caulking gun, in which the gun handle 12 and the trigger 13 are typical and are not related to the present invention and will not be described in further details.

Figure 5:
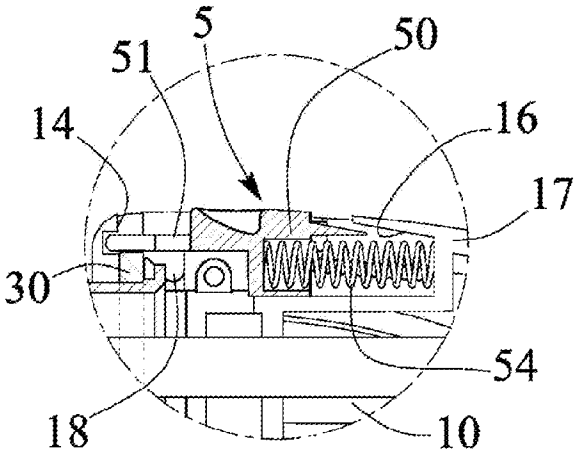
FIG. 5 is an enlarged partial cross sectional view of the caulking gun or fluid dispensing gun.
Figure 8:
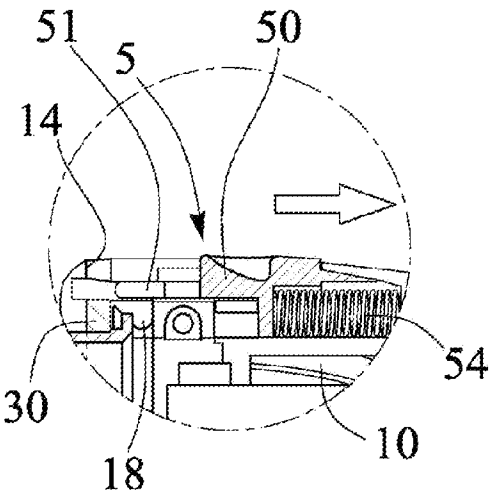
FIG. 8 is an enlarged partial cross sectional view similar to FIG. 5, illustrating the operation of the caulking gun or fluid dispensing gun.

The housing 10 further includes a groove or slot or channel 14 formed or provided in the front portion 15 thereof and directed or opened upwardly for slidably receiving or engaging with or replacing or changing or inserting or disengaging a dispensing cartridge package 2, and includes a channel or slot or groove or passage 16 formed or provided in the upper portion 17 thereof and substantially perpendicular to the channel 14 of the housing 10 and intersecting or communicating with the channel 14 of the housing 10, and includes a relatively decreased or reduced space or chamber or compartment 18 formed therein, such as formed in the front portion 15 and the upper portion 17 thereof and located between and communicating with the channel 14 and the passage 16 of the housing 10 (FIGS. 1, 5, 8).

The dispensing cartridge package 2 includes a number of cartridge members 20, 21 (FIG. 1) each having one or more (such as two) casings 22, 23 for receiving or containing or engaging with the fluid or liquid to be released or dispensed, and the cartridge members 20, 21 each include an ejection nozzle 24 for directing or guiding the fluid or liquid to flow out of the casings 22, 23. For example, the casings 22 of the cartridge member 20 include the same size or shape or volume or standard, but the casings 22, 23 of the other cartridge member 21 may include different sizes or shapes or volumes or standards, and the cartridge members 20, 21 each include an end panel 25 formed or provided at one end portion thereof and substantially perpendicular to the casings 22, 23 for solidly and stably anchoring or retaining or positioning the casings 22, 23 together. It is noted that the end panel 25 can be adapted for being slidably inserted into the insertion slots of a conventional caulking gun which has no supporting bracket.

The dispensing cartridge package 2 further includes a number of retainers or carriers or supporting brackets 30, 31 for engaging with the cartridge members 20, 21 respectively, for example, the supporting brackets 30, 31 each include a space or compartment or chamber or opening 32, 33 formed therein and having a size or shape or standard similar to or identical to that of the casings 22, 23 for selectively receiving or engaging with the casings 22, 23 and for allowing the supporting brackets 30, 31 to be fitted or attached or mounted or engaged onto the casings 22, 23 of the cartridge members 20, 21 respectively and to be contacted or engaged with the panels 25 of the cartridge members 20, 21 respectively and for slidably and selectively receiving or engaging into the channel 14 of the housing 10, and thus for removably or detachably attaching or mounting or securing or engaging the cartridge members 20, 21 to the housing 10 (FIGS. 3-4, 6-7, 9).

For example, the opening 32 of the supporting bracket 30 includes a size or shape or standard similar to or identical to that of the casings 22 of the cartridge member 20 which include the same size or shape or volume or standard for allowing the supporting bracket 30 to be snugly and firmly or solidly fitted or attached or mounted or engaged onto the casings 22 of the cartridge member 20, but the opening 33 of the other or spare supporting bracket 31 includes a size or shape or standard similar to or identical to that of the casings 22, 23 which include the sizes or shapes or volumes or standards different from each other for allowing the other or spare supporting bracket 31 to be snugly and firmly or solidly fitted or attached or mounted or engaged onto the different casings 22, 23 of the other or spare cartridge member 21.

The caulking gun or fluid dispensing gun in accordance with the present invention further comprises a plunger or driving device 4 including a carrier or transfer block 40, and one or more (such as two) ram rods 41, 42 attached or mounted or secured to the transfer block 40 and substantially parallel to each other and slidably received or engaged in the housing 10, and the ram rods 41, 42 are also slidably received or engaged into the casings 22, 23 of the cartridge members 20, 21 respectively and to be actuated or operated by the trigger 13 for selectively squeezing or releasing or dispensing the fluid or liquid contained in the casings 22, 23 of the dispensing cartridge members 20, 21. The actuation or operation of the ram rods 41, 42 of the transfer block 40 to the cartridge members 20, 21 is not related to the present invention and will not be described in further details.

The caulking gun or fluid dispensing gun in accordance with the present invention further comprises a lock or catch or latch device 5 including a lock or catch or latch member 50 slidably received or engaged in the passage 16 of the housing 10 and movable or slidable forwardly and rearwardly relative to the housing 10, or toward or away from the supporting brackets 30, 31 or the channel 14 at the front portion 15 of the housing 10, and the latch member 50 includes two legs or extensions or protrusions or stops or pawls or fingers or anchors 51, 52 extended forwardly therefrom and movable or slidable or extendible or engageable into the channel 14 of the housing 10 (FIGS. 3-5) for selectively engaging with the supporting brackets 30, 31 and for preventing the supporting brackets 30, 31 and the cartridge members 20, 21 from being disengaged or separated from the housing 10, and includes a notch or gap or space 53 formed or defined between the anchors 51, 52 (FIG. 1).

For example, the size or dimension or space or distance between the anchors 51, 52, or the size or length or width of the space 53 of the latch member 50 is equal to or slightly greater than the width of the supporting brackets 30,31 for allowing the supporting brackets 30, 31 to be selectively moved or engaged through the space 53 of the latch member 50 and to be selectively moved into or out of the housing 10 (FIG. 9), and the supporting brackets 30, 31 each include one or more (such as two) extensions or protrusions or stops or projections 35 extended radially and outwardly therefrom, such as extended radially and outwardly from the lower or bottom portion 36 thereof (FIG. 1) for selectively engaging with the anchors 51, 52 of the latch member 50 (FIGS. 9, 10) and for limiting the supporting brackets 30, 31 to slide or move relative to the housing 10 and for preventing the supporting brackets 30, 31 and the cartridge members 20, 21 from being disengaged or separated from the housing 10.

Figure 4:
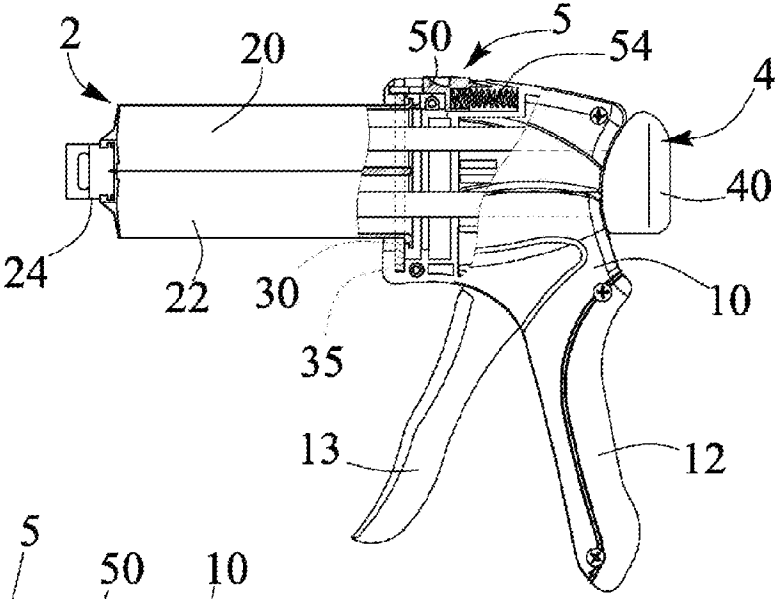
FIG. 4 is a side plan schematic view of the caulking gun or fluid dispensing gun, in which a portion of the caulking gun or fluid dispensing gun has been cut off for showing the inner structure of the caulking gun or fluid dispensing gun.
Figure 3:
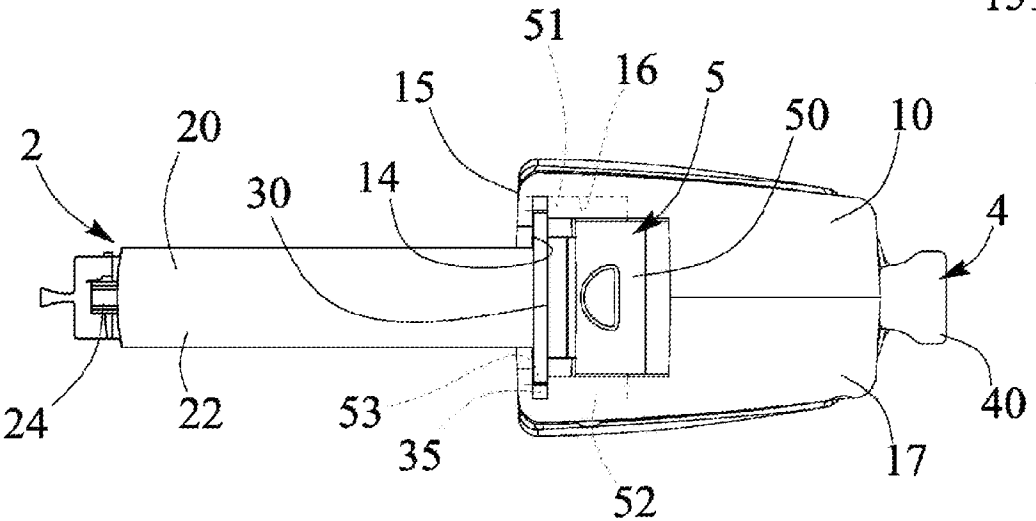
FIG. 3 is a top plan schematic view of the caulking gun or fluid dispensing gun.

In operation, as shown in FIGS. 3-5, the supporting bracket 30, 31 may be solidly and stably anchored or retained or positioned or supported in the channel 14 of the housing 10 by weight in order to solidly and stably anchor or retain or position or support the cartridge member 20, 21 on the housing 10. At this moment, the anchors 51, 52 of the latch member 50 may be biased and forced to engage into the channel 14 of the housing 10 with a spring biasing member 54 which is engaged between the latch member 50 and the housing 10. In addition, at this moment, the supporting bracket 30, 31 may be moved or slid or extended or engaged through the space 53 of the latch member 50 and may be selectively moved into or out of the housing 10 (FIGS. 9, 10), but the anchors 51, 52 of the latch member 50 may be contacted or engaged with the projections 35 of the supporting bracket 30, 31 for limiting the supporting bracket 30, 31 to slide or move relative to the housing 10 and for preventing the supporting bracket 30, 31 and the cartridge member 20, 21 from being disengaged or separated from the housing 10.

Figure 9:
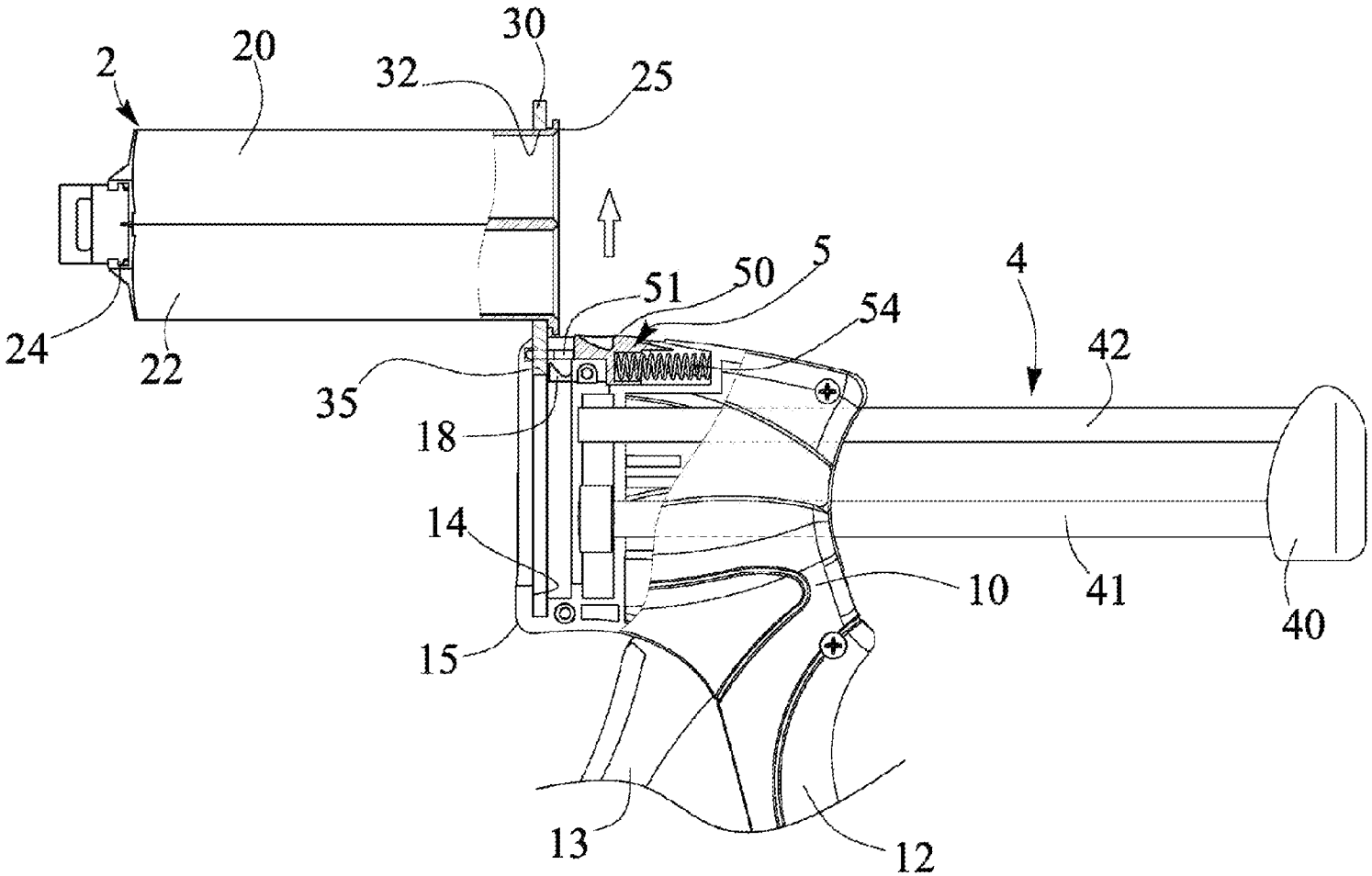
FIGS. 9 and 10 are other side plan schematic views similar to FIGS. 4 and 7, illustrating the operation of the caulking gun or fluid dispensing gun.
Figure 10:
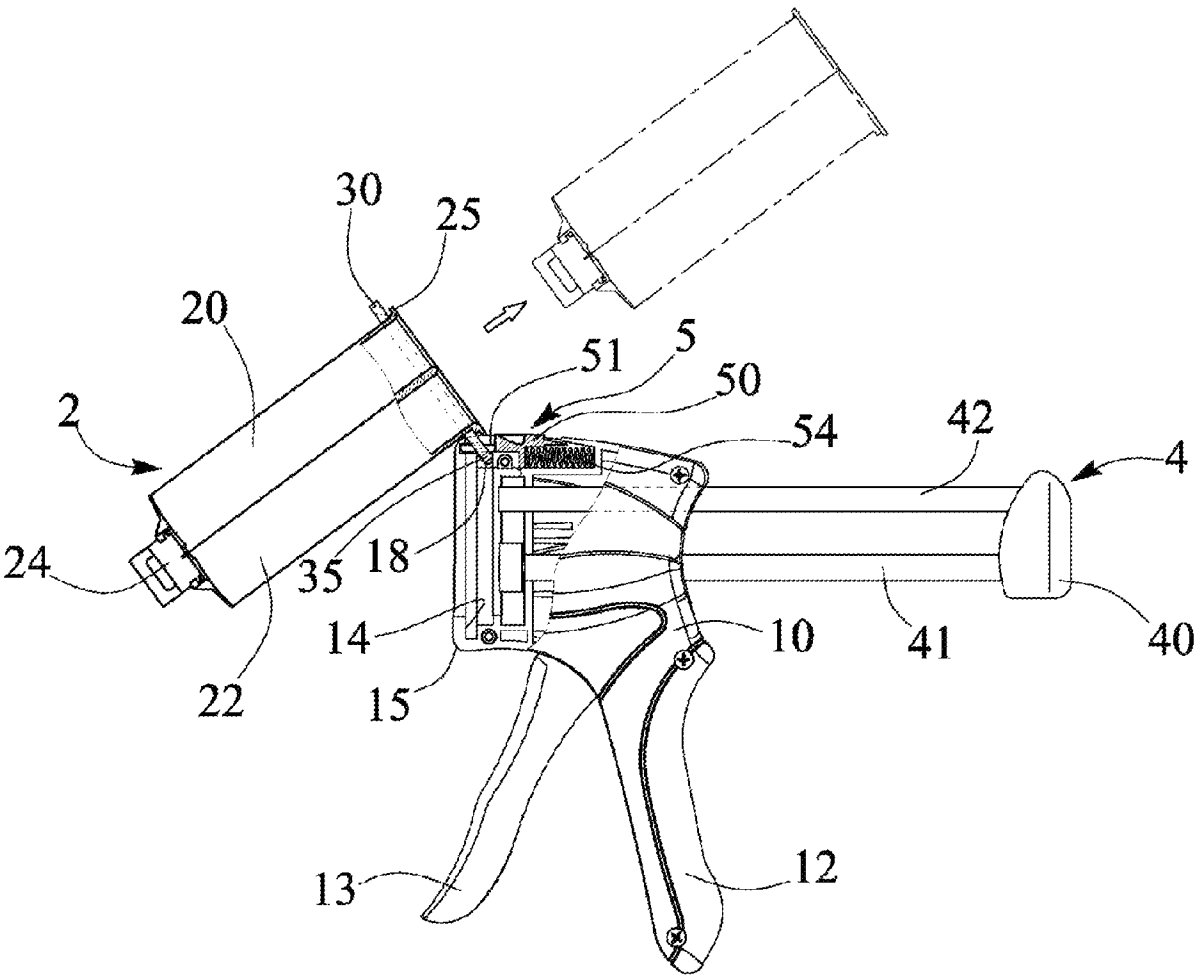

At this moment, as shown in FIGS. 9-10, the projections 35 of the supporting bracket 30 are movable or slidable or extendible or engageable into the compartment 18 that is formed in the front portion 15 and the upper portion 17 of the housing 10 and located between and communicating with the channel 14 and the passage 16 of the housing 10 (FIG. 10) for allowing the supporting bracket 30 to be slightly tilted or inclined relative to the housing 10, and thus for allowing the cartridge member 20 to be easily and quickly fitted or attached or mounted or engaged into or removed or disengaged or separated from the supporting bracket 30, and thus for allowing the cartridge member 20 to be easily and quickly replaced or changed with the new and the same or the identical cartridge member 20 that includes the same or identical size or shape or volume or standard or the like.

Figure 6:
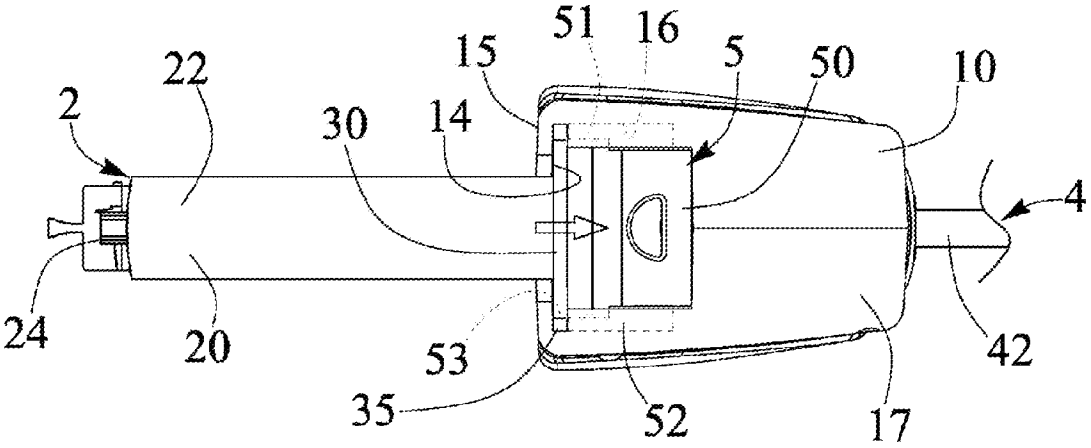
FIG. 6 is another top plan schematic view similar to FIG. 3, illustrating the operation of the caulking gun or fluid dispensing gun.
Figure 7:
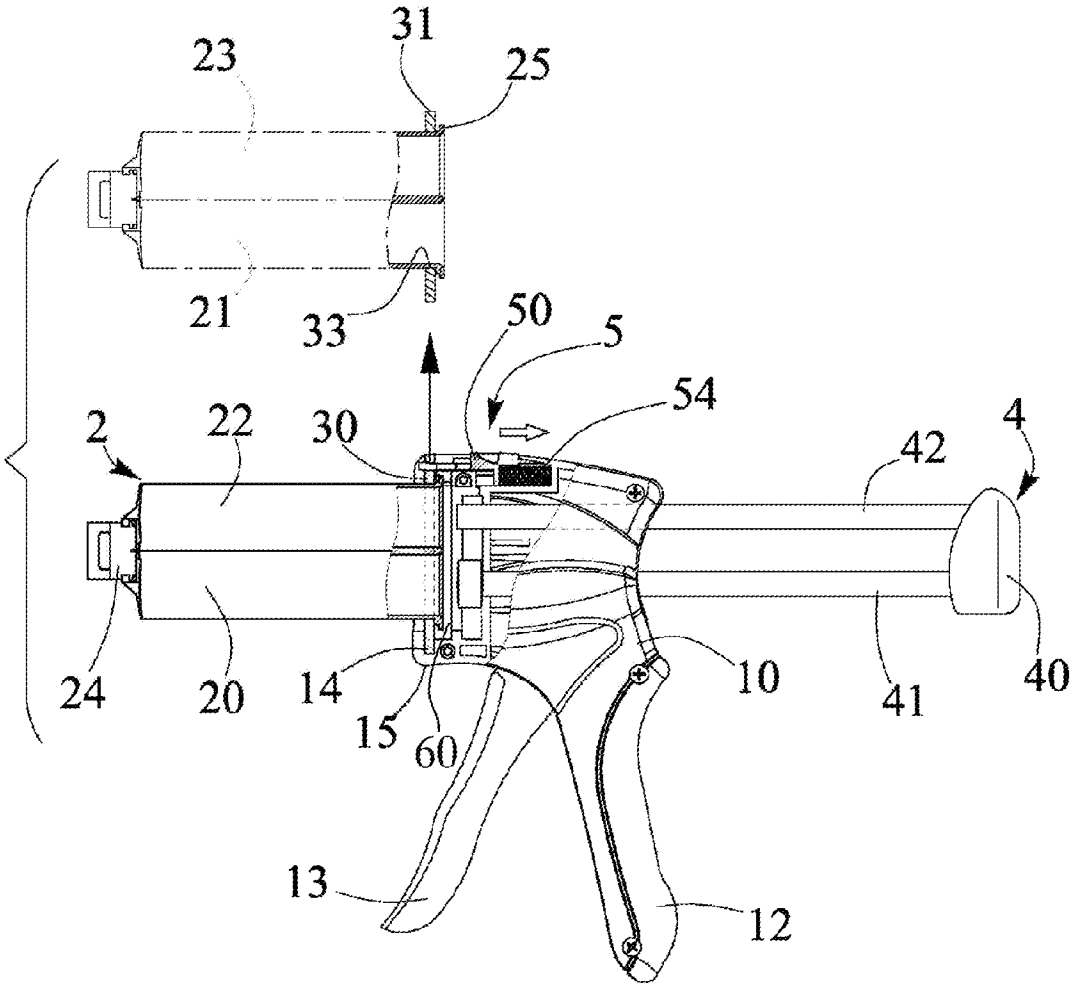
FIG. 7 is another side plan schematic view similar to FIG. 4, illustrating the operation of the caulking gun or fluid dispensing gun.

As shown in FIGS. 6-8, when the latch member 50 is moved rearwardly relative to the housing 10 and moved away from the cartridge member 20 and moved toward the spring biasing member 54 in order to depress or compress the spring biasing member 54, the anchors 51, 52 of the latch member 50 may be moved away from and removed or disengaged or separated from the supporting bracket 30 and the channel 14 of the housing 10 and may also be moved and disengaged or separated from the projections 35 of the supporting bracket 30 for allowing the supporting bracket 30 to be easily and quickly removed or disengaged or separated from the housing 10 and thus for allowing the supporting bracket 30 and the cartridge member 20 to be easily and quickly and readily replaced or changed with the new or different supporting bracket 31 and cartridge member 21.

As shown in FIGS. 5-10, specifically, said channel 14 is opened laterally (upwardly or at any other side) to form an opening 141, and said supporting bracket 30 is slidably restrained by said housing 10 within said channel 14 and further includes a marginal blocking portion which includes said two projections 35. An entirety of said supporting bracket 30 is slidable relative to said housing 10 in a single movement of said supporting bracket 30. Said latch member 50 is movable relative to said housing 10 between a block position and a release position. Preferably, said supporting bracket 30 is integrally formed as a single plate piece.

When said latch member 50 is in said block position, said latch member 50 is protrusive at said opening 141 of said housing 10 and within said channel 14, and said marginal blocking portion is laterally blockable by said latch member 50, so that said marginal blocking portion of said supporting bracket 30 is slidable toward said opening 141 of said housing 10 to abut against said latch member 50 in a manner that said opening 32 of said supporting bracket 30 is located out of said channel 14. When said latch member 50 is in said release position, said latch member 50 is non-protrusive within said channel 14, and said marginal blocking portion is laterally unblockable by said latch member 50, so that said supporting bracket 30 is withdrawable from said housing 10. Said two projections 35 of said marginal blocking portion are blockable within said channel 14 by said two anchors 51, 52 for preventing said supporting bracket 30 from being disengaged from said housing 10.

Said compartment 18 is near said opening 141 of said housing 10, said compartment 18 tiltedly travels across said channel 14 of said housing 10, and said projections 35 of said supporting bracket 30 are selectively positionably inserted within said compartment 18.

Said spring biasing member 54 normally biases said latch member 50 to move said anchors 51, 52 of said latch member 50 into said channel 14 of said housing 10, to ensure said supporting bracket 30 in lock state.

Figure 11:
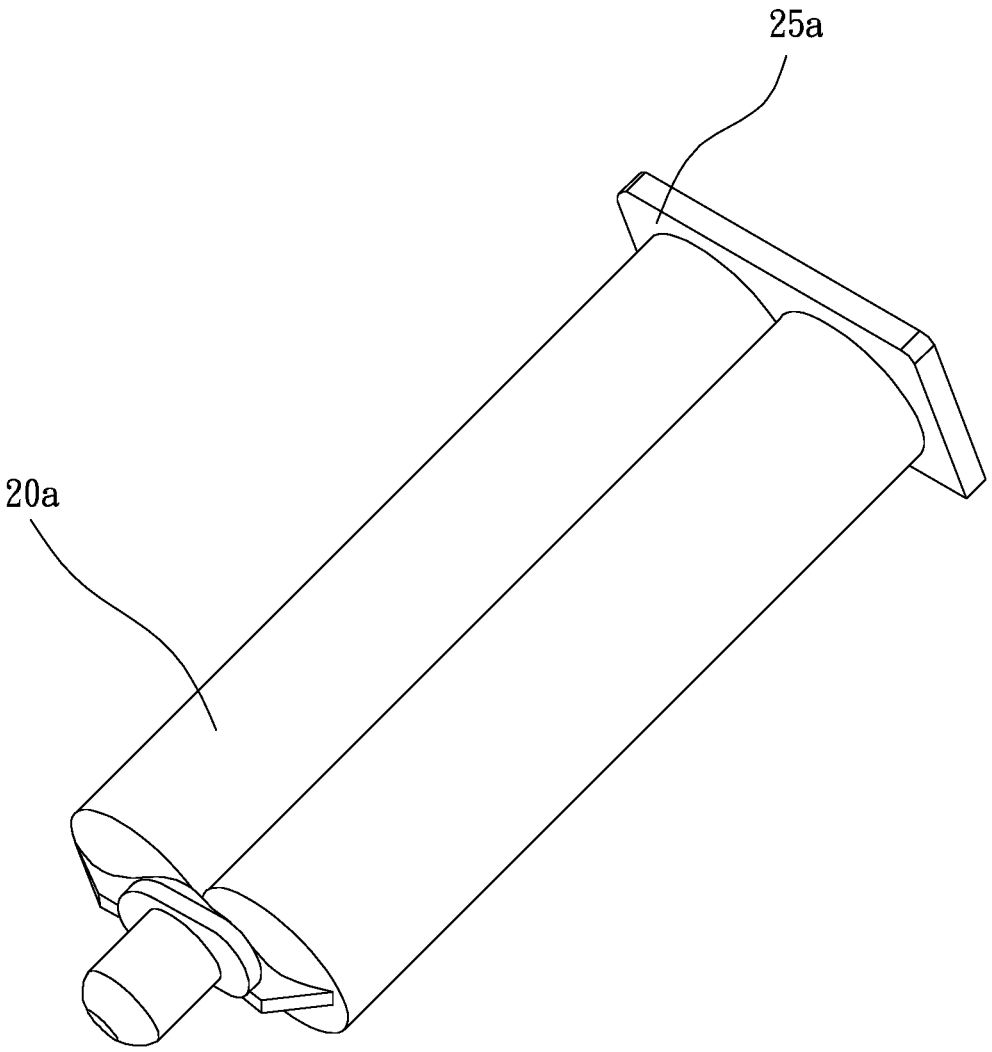
FIGS. 11-12 are drawings showing various cartridge members with respective end panels of different thicknesses or different shapes.
Figure 12:
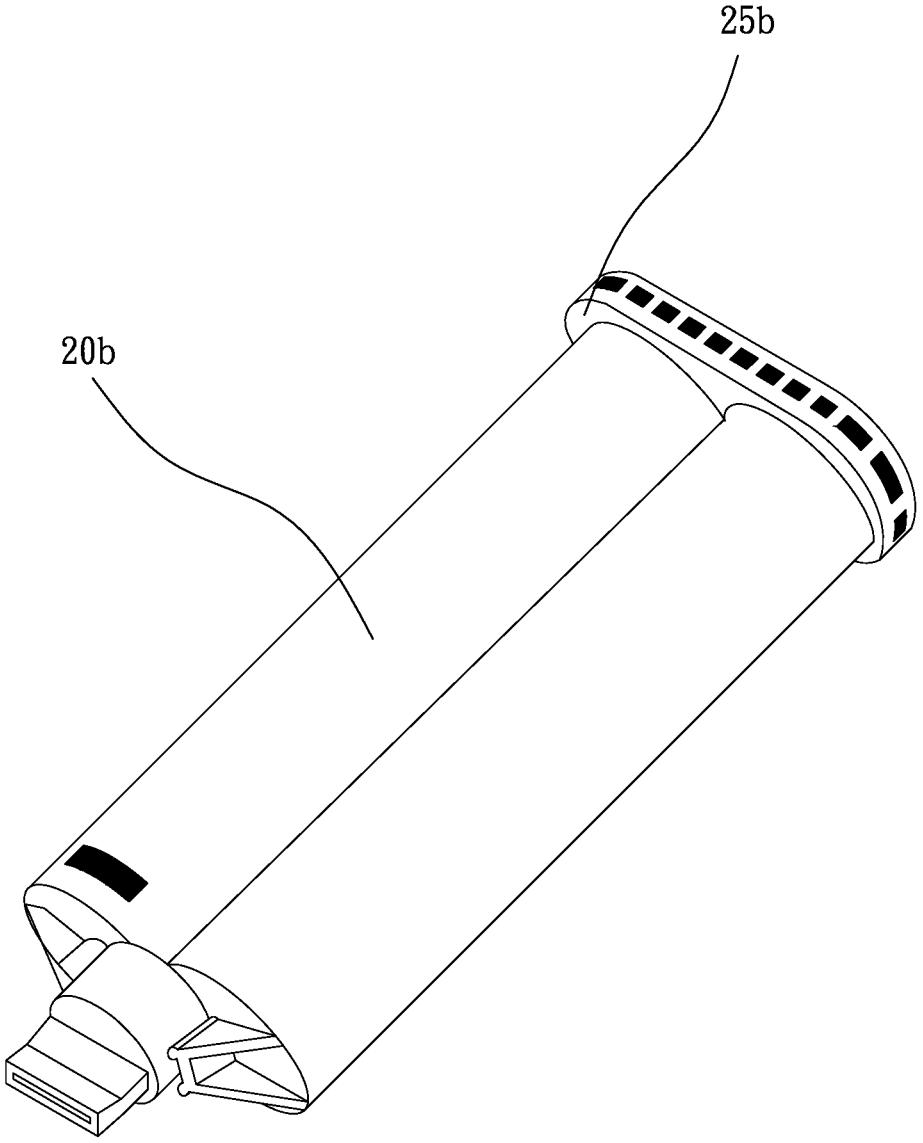

Said end panel 25 of said cartridge member 20 has a greater radial dimension than said opening 32 of said supporting bracket 30, and said end panel 25 is blockably abutable against said supporting bracket 30 in one way. As said supporting bracket 30 is inserted into and parallel to said channel 14, there is a space 60 wider than a thickness of said end panel 25, said space 60 is located by a side of said supporting bracket 30 against which said end panel 25 abuts (between said supporting bracket 30 and said front portion of said housing 10), and said end panel 25 is disposed in the space 60, and said end panel 25 is free of circumferential contact with said housing 10. As a result, said space 60 can be applied to receive various cartridge members 20, 20*a*, 20*b* with respective end panels 25, 25*a*, 25*b* of different thicknesses or different shapes (as shown in FIGS. 11-12).

Preferably, said passage 16 of said housing 10 extends linearly, said latch member 50 is slidably engaged with said passage 16 of said housing 10, and said latch member 50 is straightly movable within said passage 16 only in one dimension. As a result, it can sufficiently prevent said supporting bracket 30 from being disengaged from said housing 10.

Accordingly, the caulking gun or fluid dispensing gun in accordance with the present invention includes an improved structure or configuration for allowing the dispensing cartridge package to be easily and quickly replaced or changed with the new ones of different sizes or shapes or volumes or standards with the same caulking gun or fluid dispensing gun.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A caulking gun comprising:

a housing including a gun handle extended therefrom for being grasped by a user, and including a trigger pivotally attached to said housing, and including a channel formed in a front portion of said housing and opened laterally to form an opening;

a supporting bracket slidably insertable into said channel of said housing via said opening of said channel and including an opening, an entirety of said supporting bracket being slidable relative to said housing in a single movement of said supporting bracket, said opening of said supporting bracket is for changeably disposing a cartridge member therethrough, said cartridge member including an end panel, there being a space which is between said supporting bracket and said front portion of said housing, wider than a thickness of said end panel of cartridge member and for receiving said end panel.

2. The caulking gun as claimed in claim 1, further including a latch device, wherein said housing includes a passage formed therein for slidably receiving and engaging with said latch member, wherein said passage extends linearly, said latch member is slidably engaged with said passage of said housing, and said latch member is straightly movable within said passage only in one dimension.

3. The caulking gun as claimed in claim 1, wherein said supporting bracket further includes a marginal blocking portion, said latch device includes a latch member attached to said housing and movable relative to said housing between a block position and a release position, said latch member further includes two anchors extending outwardly therefrom and engageable into said channel of said housing, and said marginal blocking portion is blockable within said channel by said two anchors for preventing said supporting bracket from being disengaged from said housing;

wherein when said latch member is in said block position, said latch member is protrusive at said opening of said housing and within said channel, and said marginal blocking portion is laterally blockable by said latch member, so that said marginal blocking portion of said supporting bracket is slidable toward said opening of said housing to abut against said latch member in a manner that said opening of said supporting bracket is located out of said channel;

wherein when said latch member is in said release position, said latch member is non-protrusive within said channel, and said marginal blocking portion is laterally unblockable by said latch member, so that said supporting bracket is withdrawable from said housing.

4. The caulking gun as claimed in claim 3, wherein said latch member includes a space formed between said anchors for slidably receiving and engaging with said supporting bracket and for allowing said supporting bracket to be selectively engaged through said space of said latch member and to be selectively moved into and out of said housing.

5. The caulking gun as claimed in claim 4, wherein said marginal blocking portion includes two projections extending outwardly for selectively engaging with said anchors of said latch member and for limiting said supporting bracket to move relative to said housing and for preventing said supporting bracket from being disengaged from said housing.

6. The caulking gun as claimed in claim 5, wherein said housing includes a compartment formed therein and near said opening of said housing, said compartment tiltedly travels across and communicates with said channel of said housing, and said projections of said supporting bracket are selectively positionably inserted within said compartment.

7. The caulking gun as claimed in claim 3, wherein said latch device includes a spring biasing member normally biasing said latch member to move said anchors of said latch member into said channel of said housing.

8. The caulking gun as claimed in claim 1, further including a cartridge member having an end panel, wherein said cartridge member is changeably disposed through said opening of said supporting bracket, said end panel has a greater radial dimension than said opening of said supporting bracket, and said end panel is blockably abutable against said supporting bracket in one way.

9. The caulking gun as claimed in claim 8, wherein said cartridge member includes two casings for receiving a fluid to be dispensed.

10. The caulking gun as claimed in claim 9, wherein said casings of said cartridge member include a shape identical to each other.

11. The caulking gun as claimed in claim 9, wherein said casings of said cartridge member include a shape different from each other.

12. The caulking gun as claimed in claim 9, wherein said housing includes a driving device having two ram rods slidably engaged in said housing and slidably engaged into said casings of said cartridge member for selectively dispensing said fluid.

13. The caulking gun as claimed in claim 12, wherein said driving device includes a transfer block, said ram rods are attached to said transfer block and parallel to each other.

14. The caulking gun as claimed in claim 8, wherein as said supporting bracket is inserted into and parallel to said channel, and said end panel is disposed in the space, and said end panel is free of circumferential contact with said housing.

15. The caulking gun as claimed in claim 1 further comprising a spare supporting bracket engageable into said channel of said housing and including an opening formed in said spare supporting bracket, and a spare cartridge member engageable into said opening of said spare supporting bracket and detachably attached to said spare supporting bracket.

16. The caulking gun as claimed in claim 15, wherein said spare cartridge member includes a panel provided thereon for engaging with said spare supporting bracket.

17. The caulking gun as claimed in claim 15, wherein said spare cartridge member includes two casings for receiving a fluid to be dispensed.

18. The caulking gun as claimed in claim 15, wherein said casings of said spare cartridge member include a shape identical to each other.

19. The caulking gun as claimed in claim 15, wherein said casings of said spare cartridge member include a shape different from each other.

20. The caulking gun as claimed in claim 1, wherein said supporting bracket is integrally formed as a single plate piece.

* * * * *